United States Patent [19]

Gohr

[11] 3,944,099

[45] Mar. 16, 1976

[54] LOAD HOLDING DEVICE FOR MOBILE POWER CRANE EXCAVATORS AND THE LIKE

[75] Inventor: Robert A. Gohr, Pulaski, Wis.

[73] Assignee: Northwest Engineering Company, Green Bay, Wis.

[22] Filed: Mar. 4, 1974

[21] Appl. No.: 447,931

[52] U.S. Cl. ..... 214/762; 91/447

[51] Int. Cl.[2] ..... F02F 3/84

[58] Field of Search .. 214/762; 37/DIG. 1, DIG. 19; 91/358 A, 445, 447, 448

[56] References Cited

UNITED STATES PATENTS

| | | | |
|---|---|---|---|
| 3,381,587 | 5/1968 | Parquet | 91/447 |
| 3,596,566 | 8/1971 | Krehbiel | 91/447 |
| 3,640,069 | 2/1972 | Sugahara et al. | 91/447 |
| 3,691,904 | 9/1972 | Pesci | 91/447 |
| 3,843,003 | 10/1974 | Frank | 214/762 |

*Primary Examiner*—Robert J. Spar
*Assistant Examiner*—Ross Weaver
*Attorney, Agent, or Firm*—Andrus, Sceales, Starke & Sawall

[57] ABSTRACT

A control system for crane-excavators and the like wherein a metering valve is connected by fluid lines to the control cylinder for the load carrying member, such as a boom or dipper arm. A check valve and a spring biased relief valve are disposed in the fluid line on the down side of the external force created by the weight of the load carrying member on the cylinder. To prevent pressure peaking in both the upside and downside lines, as well as improper check and relief valve operation when the metering valve is moved to neutral, the metering valve is constructed to connect the downside line to the drain tank when the valve is in neutral position.

2 Claims, 2 Drawing Figures

Fig. 1
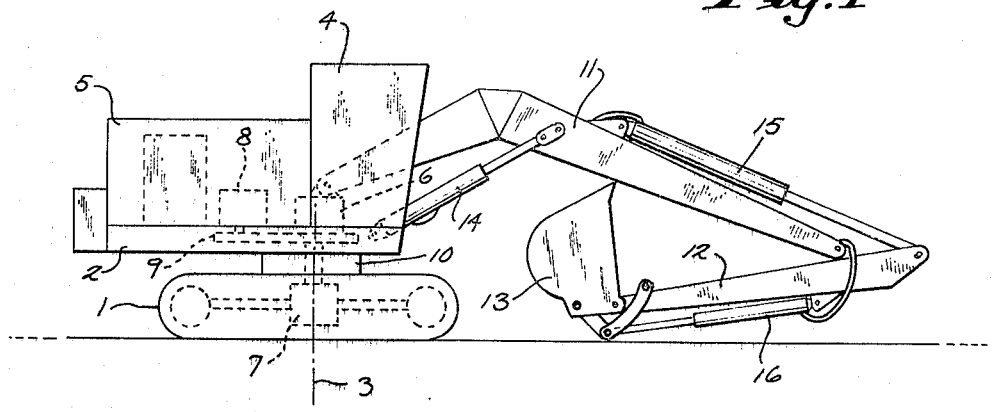
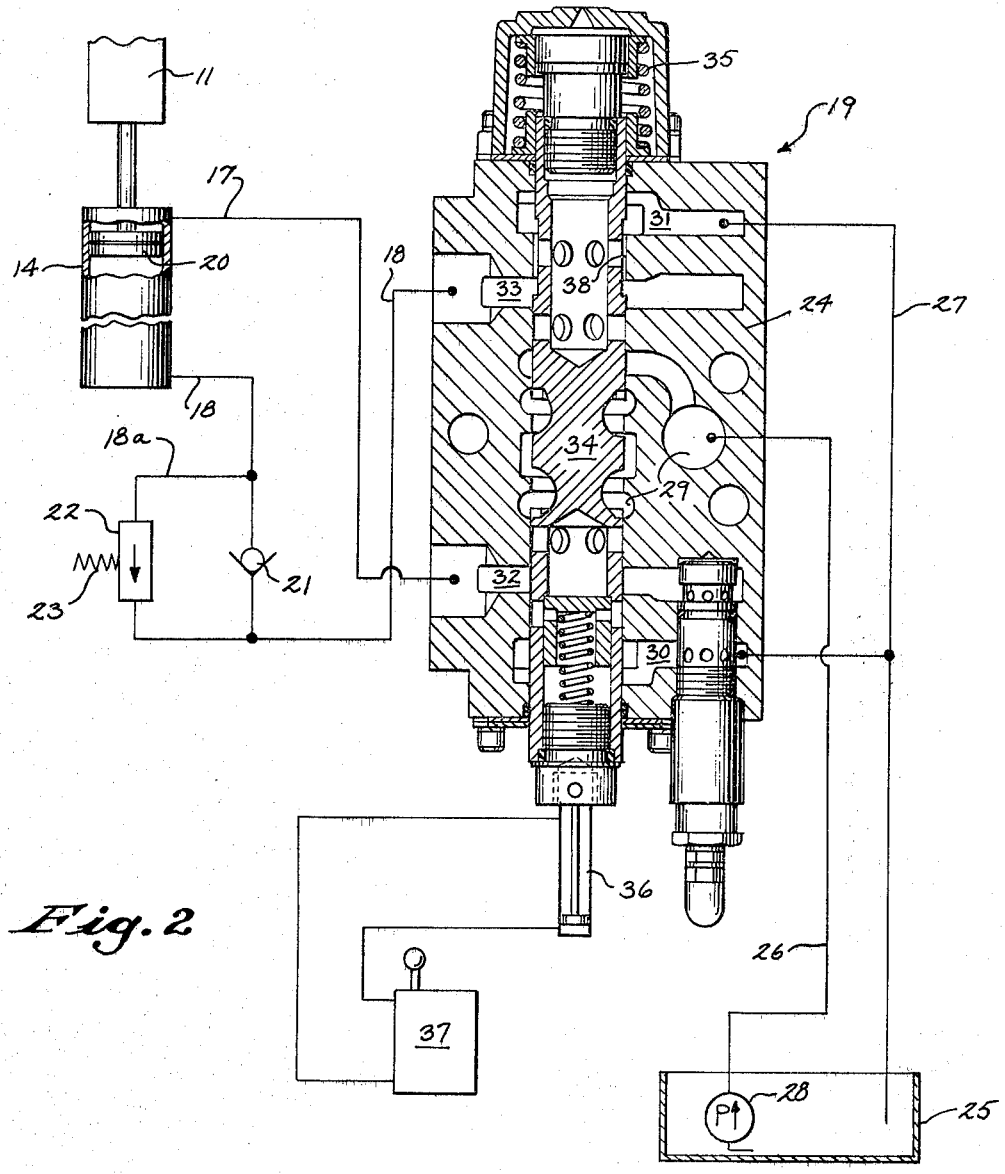
Fig. 2

LOAD HOLDING DEVICE FOR MOBILE POWER CRANE EXCAVATORS AND THE LIKE

BACKGROUND AND SUMMARY OF THE INVENTION

This invention relates to an improved load holding device for mobile power crane-excavators and the like. More particularly, the invention is directed to a device to improve the operation of check and relief valves inserted in the fluid line between a metering control valve and a function cylinder.

In power crane-excavators having a load carrying member such as a boom or dipper arm, a metering valve is often connected via fluid lines to the cylinder for the load carrying member to control the operation of the latter, such as in lowering and raising. For protection purposes, a one-way holding or check valve and a spring biased fluid relief valve have been inserted in parallel into the fluid line on the down side of the external force created by the weight of the load carrying member on the cylinder.

In such devices the metering valve is actuatable to connect pumped fluid to the desired cylinder side while the other cylinder side is opened to a fluid supply tank or drain. During lowering of the load carrying member, the fluid relief valve is overcome by the fluid pressure force. In addition, when the metering valve is in neutral position, the pump has been connected through the valve to the supply (or drain) tank to provide continuous circulation of fluid.

Heretofore, and upon shifting of the metering valve to neutral from an operating mode, certain undesirable phenomena have been observed. Pressure peaking and reverberations in both the said upside and downside lines have been noticed, which could cause line rupture, undesirable chatter-type opening of the check valve, as well as cyclic fatigue of the hydraulic system and structural load carrying members. In addition, it has been found that the fluid relief valve would not open under overload weight at the pressure it was set for, but rather required an additional amount of load pressure before opening. The design of these systems to operate properly under varying conditions of load and speed has therefor been rendered very difficult.

To the knowledge of the inventor, the cause of the aforementioned phenomena was previously unknown.

The present invention is based on the discovery by the present inventor of the said cause, and of a solution to the problems mentioned. In accordance with the invention, the cause was determined to be the fact that heretofore, and when the metering valve was in neutral, the said downside line was closed to the drain tank. Thus, when the valve was moved from an operating mode (wherein the down line was full of fluid) to neutral or load holding position, the fluid in the downside line would become suddenly trapped throughout the full length thereof, between the valve and cylinder. This was discovered to cause back pressures and the resultant pressure peaking and fluid reverberations. Furthermore, with no escape to drain available, the downside line was essentially permanently filled with pressurized fluid. The spring biased pressure relief valve therefor would not open at its normal set pressure, because any abnormal load weight would have to overcome not only the spring biasing force but also the fluid pressure in the blocked line before the valve would open.

After the discovery of the cause of the problem, the inventor has developed a simple yet unique solution to it. In accordance with the invention, the metering valve has been modified so that the downside line is opened to drain when the metering valve is in neutral. Thus, when the valve is shifted from operating mode to neutral, fluid in the down line downstream of the check and relief valves immediately drains to tank. Pressure peaking is substantially reduced and the relief valve will operate directly in accordance with its set spring biasing force.

BRIEF DESCRIPTION OF THE DRAWING

The accompanying drawing illustrates the best mode presently contemplated by the inventor for carrying out the invention.

In the drawing:

FIG. 1 is a schematic side elevation of a mobile power crane-excavator embodying the inventive concept; and FIG. 2 is a circuit diagram for the embodiment of the invention disclosed herein.

DESCRIPTION OF THE PREFERRED EMBODIMENT

As shown in FIG. 1 of the drawing, the concept of the invention is adaptable for use in a material handling crane-excavator type device mounted on crawler treads 1 and which includes a platform 2 pivotable or swingable about an upright axis 3. Platform 2 supports an operator's cab 4 as well as a rear end enclosure 5 for equipment or the like.

Suitable means are provided to drive treads 1 forward and backward, and to swing platform 2 about axis 3. For this purpose, a hydraulic travel motor 6 is connected as by a suitable drive connection 7 to treads 1. Similarly, a hydraulic swing motor 8 is connected by a suitable drive 9 to the platform support 10 which is suitably mounted for rotation about axis 3.

Suitable framework, not shown, is also mounted on platform 2 for supporting the various operating elements. The framework supports a first load carrying member or boom 11 with a second load carrying member or dipper arm 12 pivoted thereon, and with a third load carrying member or dipper 13 pivoted to the end of arm 12. One or more boom cylinders 14, dipper arm cylinders 15 and dipper cylinders 16 are mounted to their respective elements in the usual well-known manner.

The inventive concept may be applied to any load carrying member which is under the influence of such forces as gravity, springs or the like. It therefor may be applied to any of the three aforementioned elements 11, 12 or 13 and their functions. For purposes of brevity, it will be described only in connection with boom 11 and a single cylinder 14 therefor.

As best shown in FIG. 2, the opposite upside and downside ends of double acting boom control cylinder 14 are respectively connected through hydraulic fluid lines 17 and 18 to a metering control valve 19 of the spool type. Line 17 is shown on the up side of cylinder piston 20, while line 18 is on the down side thereof so that the latter line is subjected to the external load forces applied by the weight of boom 11 on piston 20.

In the embodiment shown, a pair of valves are disposed on the down side of cylinder 14. A one way holding valve such as ball check valve 21 is disposed in line 18 to prevent sudden dropping of the load. In addition, a relief valve 22 is also disposed in line 18*a* in parallelism with valve 21. Valve 22 may be of any suitable well-known type which is pre-settable to open upon the application of a hydraulic pressure force greater than the selected biasing force. As an example, valve 22 may be set to open when the hydraulic pressure load on a spring 23 reaches 6000 pounds. This would represent the maximum safe limit of load on boom 11. Anything beyond that would represent an overload and open valve 22.

Metering valve 19 is provided with an elongated valve body 24 which is connected to a reservoir of hydraulic fluid such as a sump or tank 25, as by a supply line 26 and a drain line 27. Line 26 is provided with a suitable pump 28, and connects to a central pressurized inlet passage 29 and selectively to end passages 30, 31 in valve body 24, as will be discussed. Drain line 27 is branched and connects end passages 30, 31 to tank 25. A pair of work ports 32, 33 are also disposed in body 24 inwardly of end passages 30, 31, with port 32 connected to upside line 17 and port 33 connected to downside line 18.

Metering valve 19 includes a spool 34 which is shiftable within body 24 against the force of double acting spring means 35 which acts to keep the spool in neutral position, as shown. The shifting means may comprise an air cylinder 36 operated by a manually actuated boom control air valve 37, as disclosed in U.S. Pat. No. 3,578,787.

When spool 34 is shifted downwardly, valve passage 29 will connect through the spool to port 33 and line 18, which is closed to drain; while line 17 and port 32 will connect to drain through passage 30 and line 27. This will extend cylinder 14 toward its boom raised position. When spool 34 is shifted upwardly, valve passage 29 will connect to port 32 and line 17, which is closed to drain; while line 18 and port 33 will connect to drain through passage 31 and line 27. Relief valve 22 will open under the pressure from piston 20 which comprises the combined additive effect to fluid pressure in line 17 plus the pressure caused by the weight of the boom load. This total pressure is in excess of the relief valve pressure setting and will retract cylinder 14 toward its boom lowered position.

The invention contemplates a means for eliminating the heretofore described phenomena which occurred when the spool was shifted back into neutral from the raising mode. (At this time, and as shown in FIG. 2, the spool connection between upside line 17 and drain line 27 is blocked.) For this purpose, downside line 18, which heretofore has only been opened to drain when the spool was in its boom lowering position (i.e. up), is according to the invention now opened to drain on the downstream side of valves 21 and 22 when spool 34 is in neutral. In this embodiment, the relieving connection is accomplished by an annular longitudinally extending bridging passage 38 formed between valve body 24 and spool 34, and connecting port 33 with drain passage 31.

Bridging passage 38 causes downside line 18 to empty downstream of valves 21 and 22 when the spool is moved from a load-raising mode to a neutral or load-holding mode. Under these circumstances, any hydraulic resistance in line 18 downstream of valves 21 and 22 is removed. There can be no pressure peaking or reverberations in line 18, check valve 21 will not chatter, and relief valve 22 is free to operate thereafter in exact accordance only with its set pressure relationship to the upside line pressure and load weight and free of said resistance.

While the embodiment shown primarily utilizes hydraulic fluid, any other fluid such as air may be used without departing from the inventive concept. Similarly, other relief and check valves may be incorporated in the circuit as needed. In addition, other material handling devices than the one disclosed herein may incorporate the inventive concept to advantage.

Various modes of carrying out the invention are contemplated as being within the scope of the following claims particularly pointing out and distinctly claiming the subject matter which is regarded as the invention.

I claim:

1. In a material handling apparatus having a load carrying member under the influence of gravity or the like, a control system comprising:

a. a double acting cylinder connected to said load carrying member for raising and lowering the latter, b. a control valve connected to a drain and comprising a valve body having a spool therein, c. means to shift said spool between a neutral load holding mode and load raising and load lowering modes, d. upside and downside fluid lines disposed between said valve body and the respective upside and downside ends of said cylinder, e. said downside line being closed to said drain when said spool is in load raising mode, and being open to said drain when said spool is in load lowering mode, f. a check valve and a relief valve disposed in parallelism in said downside line with said relief valve being responsive to a set pressure, g. means to create a pressure in the said upside line which when added to the pressure caused by the weight of said load carrying member produces a total pressure in said downside line in excess of said set pressure for opening said relief valve, said pressurizing means being responsive to shifting of said spool out of neutral mode by said shifting means, h. and a bridging passage in said control valve between said valve body and said spool to connect said downside line to said drain whenever said spool is in neutral mode to thereby drain fluid in said downside line downstream of said check valve and said relief valve so that no resistance exists in said downside line against the opening of said relief valve at its set pressure, i. the control valve connection between said upside line and said drain being blocked when said spool is in both said load lowering and neutral modes.

2. In a material handling apparatus having a load carrying member under the influence of gravity or the like, a control system comprising:

a. a double acting cylinder connected to said load carrying member for raising and lowering the latter, b. a control valve connected to a drain and comprising a valve body having a spool therein, c. means to shift said spool between a neutral load holding mode and load raising and load lowering modes, d. upside and downside fluid lines disposed between said valve body and the respective upside and downside ends of said cylinder, e. said downside line being closed to said drain when said spool is in load raising mode, and being open to said drain when said spool is in load lowering mode, f. a check valve and a relief valve disposed in parallelism in said downside line with said relief valve being responsive to a set pressure, g. means to create a pressure in the said upside line which when added to the pressure caused by the weight of said load carrying member produces a total pressure in said downside line in excess of said set pressure for opening said relief valve, said pressurizing means being responsive to shifting of said spool out of neutral mode by said shifting means, h. and means to remove any hydraulic resistance occurring in said downside line downstream of said check valve and relief valve when said spool is moved into neutral mode so that said relief valve will thereafter open in accordance only with its said set pressure relationship to said upside line pressure and said load weight and free of said resistance, i. said hydraulic resistance removal means comprising a bridging passage in said control valve between said valve body and said spool to connect said downside line downstream of said check valve and said relief valve to said drain whenever said spool is moved into neutral mode.

* * * * *